US010247053B1

(12) United States Patent
Schubeck

(10) Patent No.: US 10,247,053 B1
(45) Date of Patent: Apr. 2, 2019

(54) AXLELESS ROLLER VALVE LIFTER

(71) Applicant: Joseph Schubeck, Henderson, NV (US)

(72) Inventor: Joseph Schubeck, Henderson, NV (US)

( * ) Notice: Subject to any disclaimer, the term of this patent is extended or adjusted under 35 U.S.C. 154(b) by 3 days.

(21) Appl. No.: 15/791,600

(22) Filed: Oct. 24, 2017

(51) Int. Cl.
*F01L 1/14* (2006.01)
*F01L 1/245* (2006.01)
*F01L 1/46* (2006.01)

(52) U.S. Cl.
CPC ..... *F01L 1/245* (2013.01); *F01L 1/14* (2013.01); *F01L 1/46* (2013.01); *F01L 2105/02* (2013.01)

(58) Field of Classification Search
CPC ..... F01L 1/14; F01L 1/46; F01L 2105/02
USPC ..... 123/90.48, 90.55
See application file for complete search history.

(56) References Cited

U.S. PATENT DOCUMENTS

| | | | | |
|---|---|---|---|---|
| 1,210,871 | A | 1/1917 | Suffa | |
| 4,106,826 | A | 8/1978 | Marola et al. | |
| 4,366,785 | A | 1/1983 | Goloff et al. | |
| 4,616,389 | A | 10/1986 | Slee | |
| 4,708,102 | A | 11/1987 | Schmid | |
| 4,768,476 | A | 9/1988 | Behnke et al. | |
| 4,850,095 | A | 7/1989 | Akao et al. | |
| 4,907,330 | A | 3/1990 | Akao et al. | |
| 5,168,841 | A | 12/1992 | Suzuki et al. | |
| 5,178,107 | A | 1/1993 | Morel, Jr. et al. | |
| 5,185,923 | A | 2/1993 | Taniguchi et al. | |
| 5,566,652 | A | 10/1996 | Deppe | |
| 5,934,232 | A | 8/1999 | Greene et al. | |
| 6,216,583 | B1 | 4/2001 | Klinger et al. | |
| 6,318,324 | B1 | 11/2001 | Koeroghlian et al. | |
| 6,328,009 | B1 | 12/2001 | Brothers | |
| 6,820,581 | B2 | 11/2004 | Vene | |
| 6,871,622 | B2 | 3/2005 | Mandal et al. | |
| 7,207,302 | B2 | 4/2007 | Williams et al. | |
| 7,281,329 | B2 | 10/2007 | Mandal et al. | |
| 7,284,520 | B2 | 10/2007 | Mandal et al. | |
| 7,748,359 | B2 | 7/2010 | Bartley et al. | |
| 8,464,678 | B1 | 6/2013 | Iskenderian | |
| 8,695,215 | B2 | 4/2014 | Schober | |
| 8,851,038 | B1 | 10/2014 | Iskenderian | |
| 9,334,767 | B2 | 5/2016 | Haefner et al. | |
| 2006/0005797 | A1* | 1/2006 | Schubeck | F01L 1/146 123/90.48 |
| 2015/0136053 | A1 | 5/2015 | Haefner et al. | |

* cited by examiner

*Primary Examiner* — Jorge Leon, Jr.
(74) *Attorney, Agent, or Firm* — Erickson Kernell IP, LLC; Mark C. Young

(57) ABSTRACT

An axleless roller valve lifter for following an eccentric cam in an internal combustion engine includes a roller wheel contained and suspended within a wheel socket without the use of a center support axle. The inner contour of the wheel socket is precision machined to receive the outer diameter of the roller wheel, with a thin film of non-compressible oil providing a barrier between the roller and the well during operation. A permanent magnet within the body of the lifter assists in retaining the wheel within the well, and a check valve within the lifter body prevents oil from backflowing out of the lifter upon impact of the roller with the cam.

9 Claims, 7 Drawing Sheets

AXLELESS ROLLER VALVE LIFTER

BACKGROUND

The present invention relates generally to valve lifters for use in internal combustion engines. More particularly, the present invention relates to an axleless roller valve lifter.

Internal combustion engines typically comprise two or more valves associated with each cylinder to regulate intake and exhaust to and from the cylinder. The valves are commonly opened and closed by the rotation of a camshaft comprising a plurality of eccentric cams disposed on a shaft which rotates synchronously with the engine. A valve lifter is associated with each valve, with each lifter in contact at one end with one cam of the camshaft, the other end of the lifter is typically connected to or engages with a push rod, which in turn is connected to a spring-biased rocker arm assembly which actuates the corresponding valve. The spring bias typically maintains the valve in a normally closed position until the valve is opened upon actuation via the lifter. Thus, rotational motion of the camshaft translates into linear motion of the valve, which opens and closes as the camshaft rotates.

Valve lifters known in the art typically employ a roller wheel suspended on an axle attached to the lower end of the lifter body. The roller wheel contacts and rolls across the surface of the eccentric cam so that the lifter body raises and lowers in unison with the cam to actuate a push rod and rocker arm as described above. A series of needle bearings positioned radially around an axial center of the roller wheel enables the roller wheel to rotate freely about an axle, with the ends of the axle supported by arms or tabs extending from the lower portion of the lifter body. Thus, the needle bearings are in metal-to-metal contact with the axis of the roller wheel with oil introduced into the bearings providing some cooling by transferring heat from the bearings.

While conventional valve lifters generally perform their intended function, they are not without drawbacks. Because the needle bearings are in physical contact with the roller and the axle, there is continuous frictional wear between those contacting surfaces during operation of the engine. That wear is exacerbated during each lift and engine combustion cycle when additional forces are imparted to the needle bearings. Thus, the needle bearings and roller wear relatively quickly, particularly in high-performance applications. In those applications, such as drag racing, race teams often replace the lifters after a few runs rather than risk the inevitable failure of a worn lifter.

Thus, it can be seen that there remains a need in the art for an improved roller valve lifter.

SUMMARY

Embodiments of the invention are defined by the claims below, not this summary. A high-level overview of various aspects of the invention is provided here to introduce a selection of concepts that are further described in the Detailed Description section below. This summary is not intended to identify key features or essential features of the claimed subject matter, nor is it intended to be used in isolation to determine the scope of the claimed subject matter. In brief, this disclosure describes, among other things, an axleless roller valve lifter for internal combustion engines having a roller wheel within a wheel socket, an inner check valve, and a permanent magnet for retaining the wheel.

The present invention is directed to an axleless roller valve lifter for internal combustion engines. The lifter comprises a body having a lower section with a curved wheel socket machined therein, the wheel socket configured to conform to the outer diameter of a roller wheel so that the roller wheel fits into, and is contained within, the wheel socket. The arc of the wheel socket extends one-hundred and eighty degrees. An interior passageway within the lifter body allows oil to be introduced into the wheel socket.

In operation, oil introduced into the lifter body forms a thin film between the outer surface of the roller wheel and the curved inner wall of the wheel well. The roller wheel rotates against the film of oil within the wheel well, without the use of an axle or any other supporting structure.

In one embodiment, the lifter body is manufactured of lightweight aluminum, with a permanent magnet positioned within the lifter body further securing the steel wheel within the wheel socket via the attractive force between the permanent magnet and the wheel.

In another embodiment, a check valve positioned within the interior passageway allows oil to flow into the wheel socket area but prevents oil from exiting through the passageway upon impact of the roller imparted through the cam. Preferably the check ball within the check valve is manufactured from ceramic or other non-conductive material to prevent magnetic interference with the operation of the ball.

Thus, the valve lifter of the present invention provides a lightweight solution to problems associated with prior art valve lifters, providing a low-wear roller assembly and a solution for eliminating the axle and needle bearings.

DESCRIPTION OF THE DRAWINGS

Illustrative embodiments of the invention are described in detail below with reference to the attached drawing figures, and wherein.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about", "approximately", or "substantially" as used herein denote deviations from the exact value in the form of changes or deviations that are insignificant to the function.

Embodiments of the invention include various features of an axleless roller valve lifter for internal combustion engines. Various embodiments of the lifter include various elements and features to improve the operability of the lifter. It should be understood that while the various features of the lifter will be described in various combinations in the embodiments herein, other combinations of those features will be apparent to those skilled in the art. Such combinations and sub combinations are contemplated and the invention is not limited to the specific exemplary embodiments described. For example, while an exemplary embodiment herein may describe the use of a permanent magnet to retain the roller wheel and a check valve in the interior passageway of the lifter body to prevent oil backflow, those features may be separately employed in other embodiments of the invention not specifically described herein, within the scope of the present invention.

Figure 1:
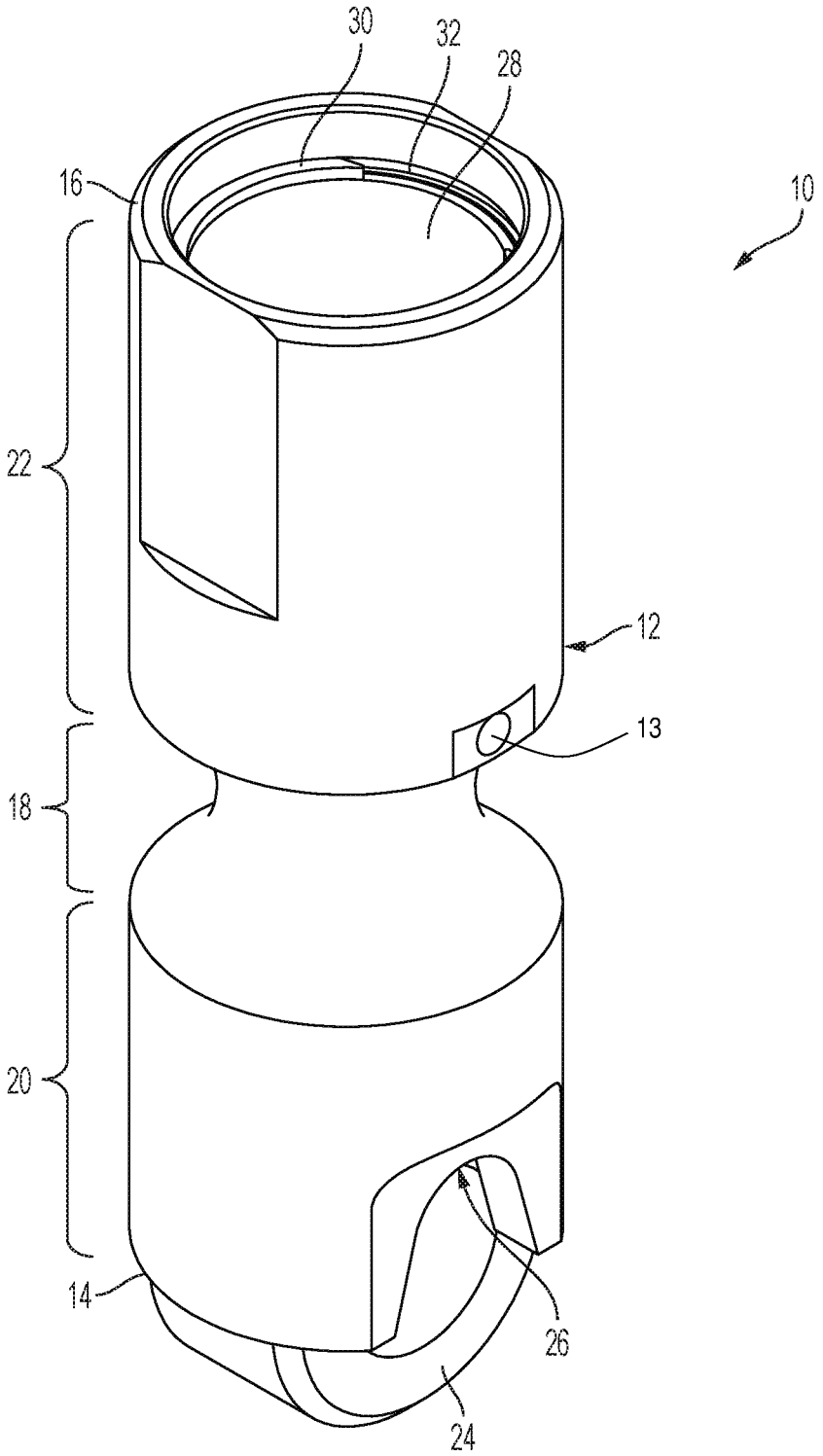
FIG. 1 is a perspective view of an axleless roller valve lifter in accordance with an exemplary embodiment of the present invention.

Looking first to FIG. 1, a perspective view of an axleless roller valve lifter in accordance with an exemplary embodiment of the present invention is depicted by the numeral 10. As seen in the figure, the lifter 10 comprises a generally hourglass-shaped cylindrical main body 12 extending between a lower end 14 and an upper end 16, with a recessed U-shaped valley 18 extending circumferentially around the main body 12 to form the hourglass shape and define a lower section 20 and an upper section 22 of the main body.

Figure 6:
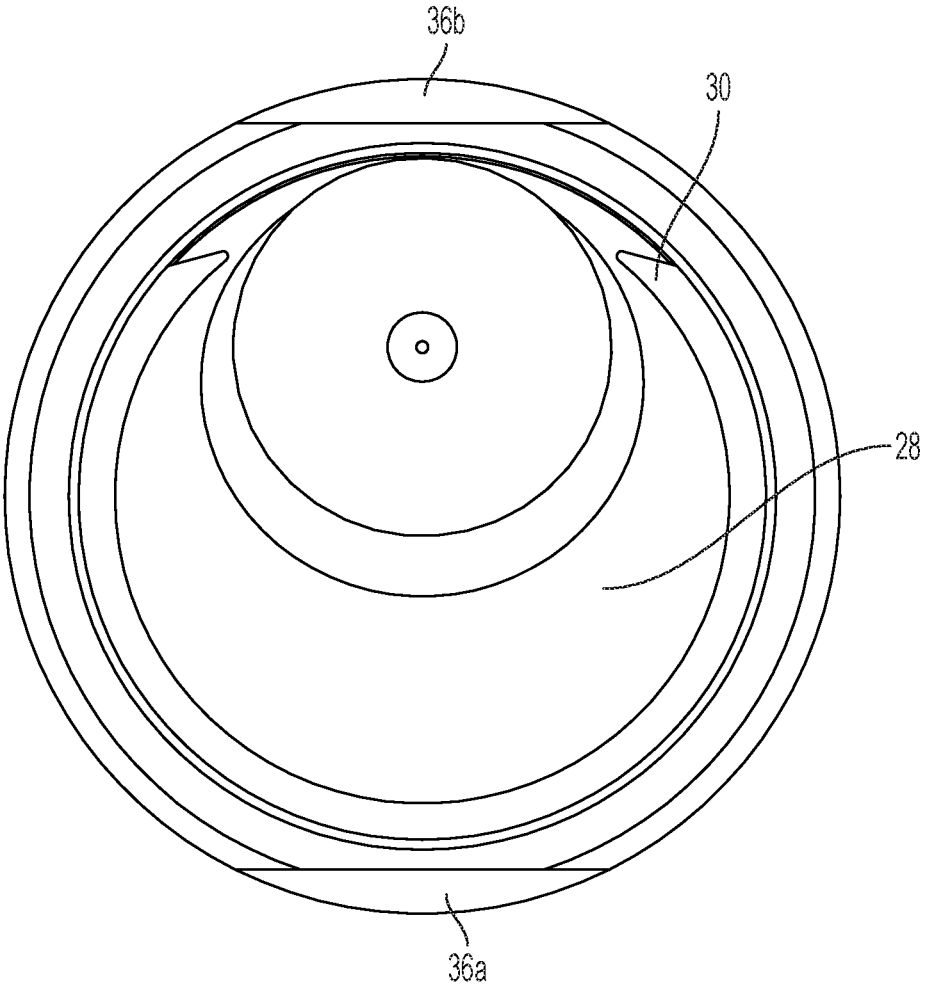
FIG. 6 is a top view of the axleless roller valve lifter of FIG. 1.

A roller wheel 24 is partially enveloped by, and extends from, a wheel socket 26 formed in the lower section 20. As seen in viewing FIG. 1 in conjunction with FIG. 6, a push rod seat 28 positioned within the open end of the upper section 22, the push rod seat 28 retained within the upper section 22 by a retaining clip 30 fitted into a groove 32 formed in the circumference of the interior surface of the upper section 22. As can be seen in FIG. 6, the use of the retaining clip 30 permits a maximum offset to the push rod seat, preferably approximately 0.180 inches.

Figure 2:
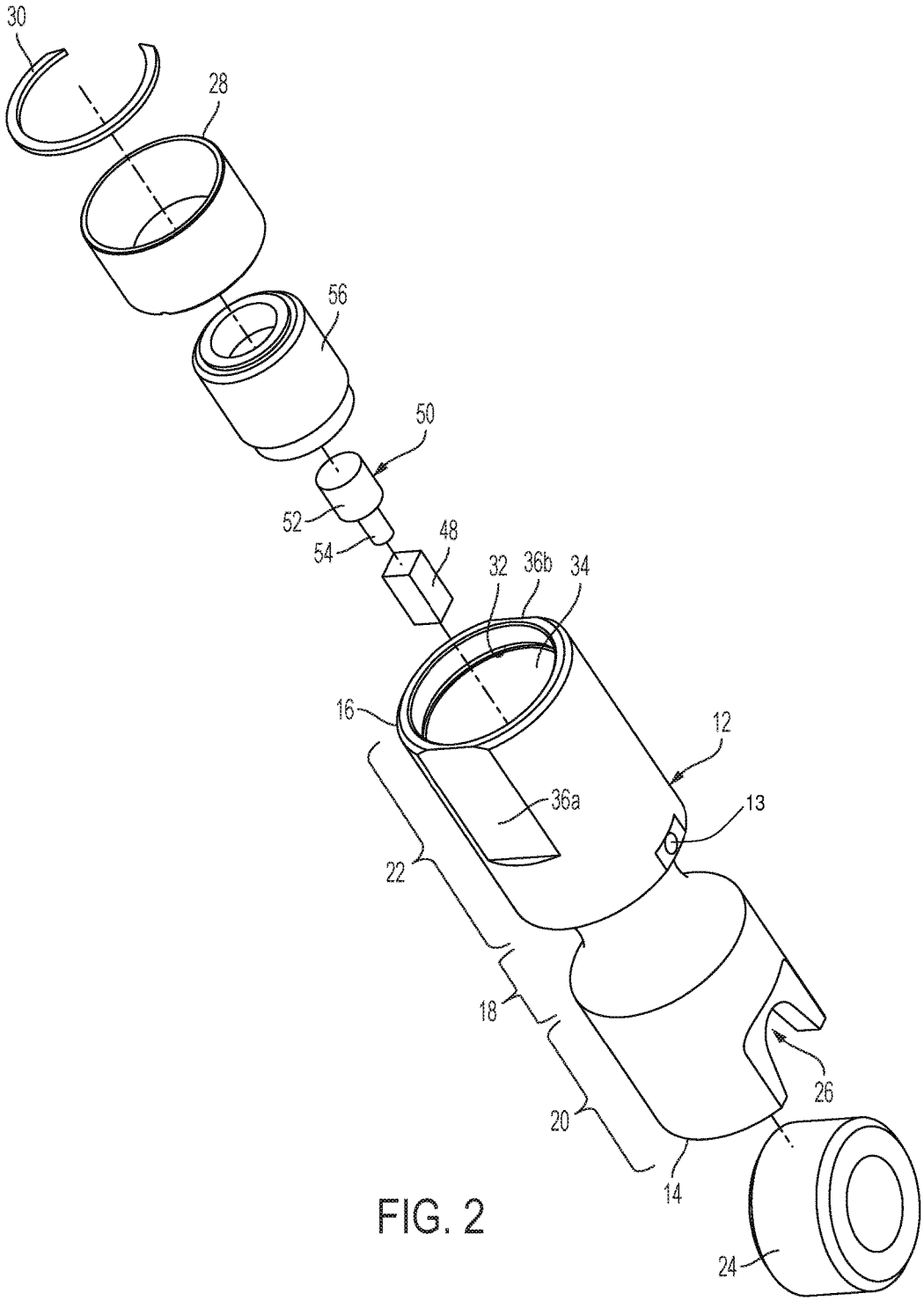
FIG. 2 is an exploded view of the axleless roller valve lifter of FIG. 1.

Looking to FIG. 2, upper section 22 of the main body is cylindrical in shape, defining a cylindrical inner cavity 34 therein, with flats 36*a*, 36*b* formed on opposing sides of the outer surface of the cylindrical upper section. The flats 36*a*, 36*b* allow the lifter wheel 12 to be kept in alignment with the cam lobe.

Figure 4:
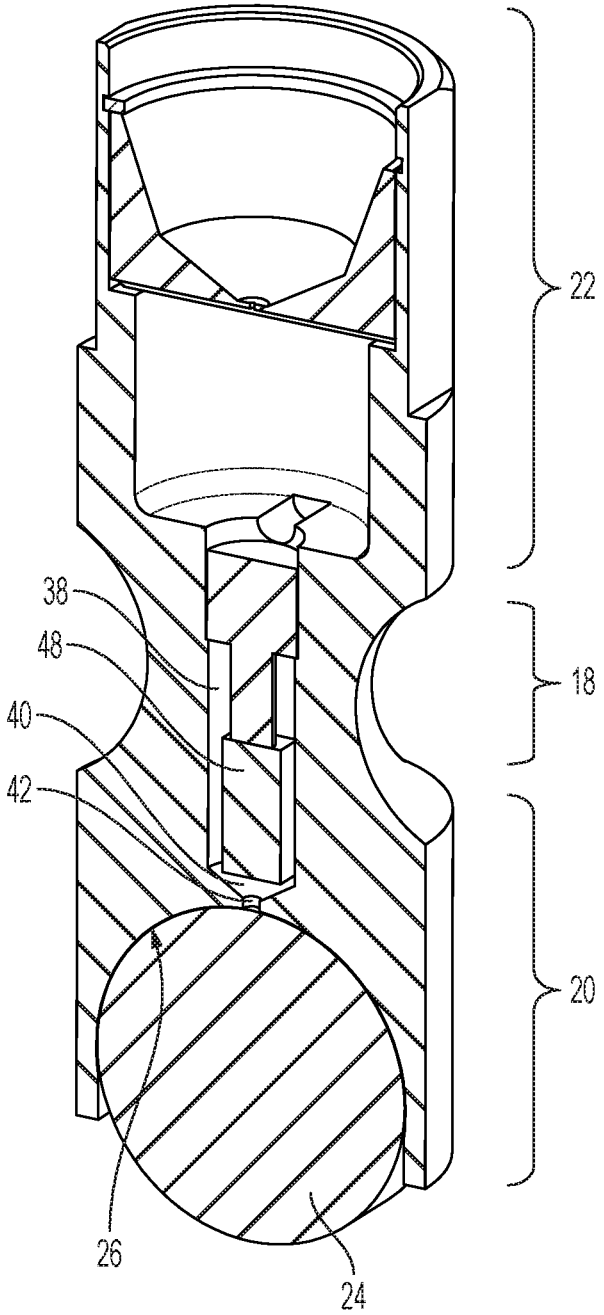
FIG. 4 is a cross-sectional view of the axleless roller valve lifter of FIG. 1 along a plane perpendicular to a center axis of the roller.
Figure 5:
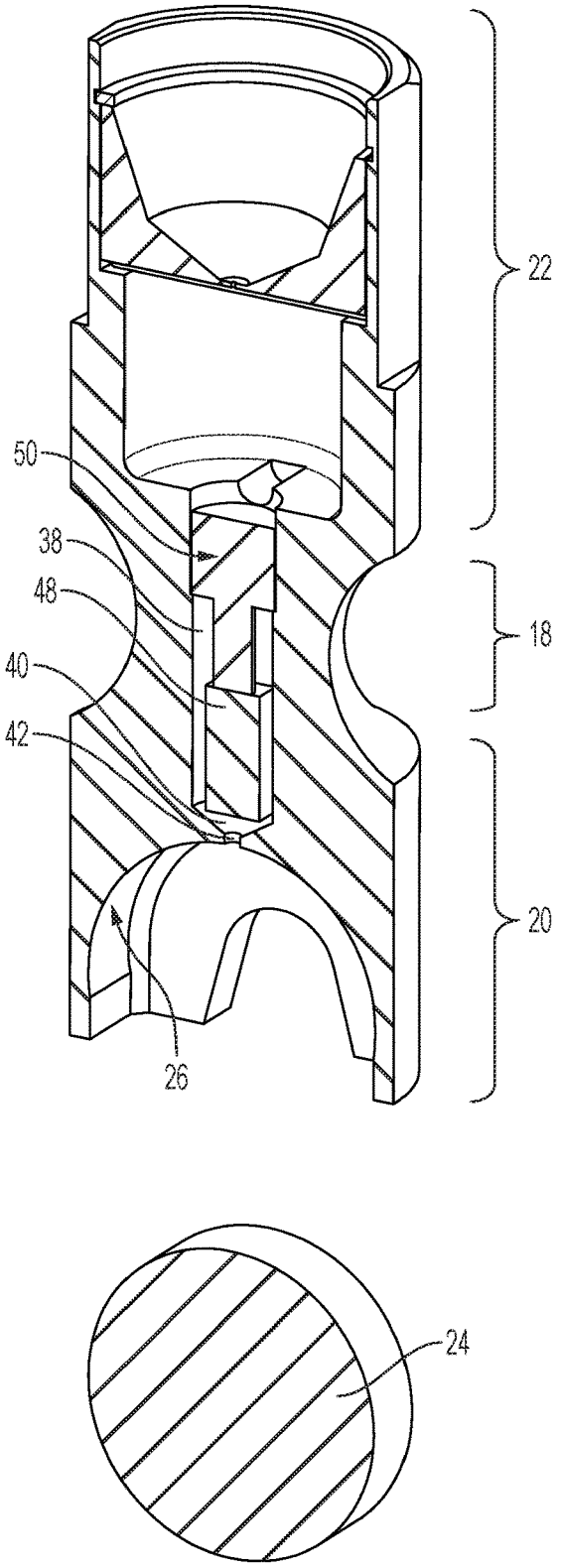
FIG. 5 is an exploded cross-sectional view of the axleless roller valve lifter of FIG. 1 along a plane perpendicular to a center axis of the roller.

Viewing FIGS. 4 and 5 in conjunction with FIG. 2, it can be seen that the curved wheel socket 26 is machined into the lower section 20 and extends upwardly into the lower section 20 to form a receptacle for the roller wheel 24. As best seen in FIG. 4, the inner surface of the wheel socket 26 is machined to conform closely to the outer diameter of the roller wheel 24. Most preferably the diameter of the wheel socket 26 is approximately between one thousandth and three thousandths of an inch greater than the diameter of the roller wheel 24. The precision machined wheel socket 26 allows the roller wheel 24 to glide against a film of lubricating oil between the socket and the wheel.

Preferably, the main body 12 is formed or machined from a strong, lightweight material such as aluminum. Most preferably, the main body is formed of hard anodized aluminum, with Teflon® coating applied on the bearing surfaces. Because prior art roller lifters employ an axle to support and secure the roller wheel within the wheel socket, the main body portions of those lifters must typically be formed of steel in order to support the axle. The axleless design of the present invention allows the main body 12 to be formed of aluminum, and thus to be much lighter weight material than steel.

Looking still to FIGS. 2 and 4, a cylindrical passageway 38 extends between the upper section 22 and the lower section 20, terminating in a conical guide 40 and oil aperture 42. The passageway 38 transports oil from the upper section 22 to the lower section, and through the conical guide 40 and oil aperture 42, where the oil lubricates the roller wheel 24 and provides a thin film of lubricating oil between the outer surface of the roller wheel 24 and the inner surface of the wheel socket 26.

Oil is introduced into the valve lifter from the oil gallery through aperture 13, positioned at approximately the midpoint of the valve lifter body, having a diameter of approximately 0.90 inches. The oil enters the valve lifter body and travels upward towards the push rod and downward towards the roller wheel.

Figure 3:
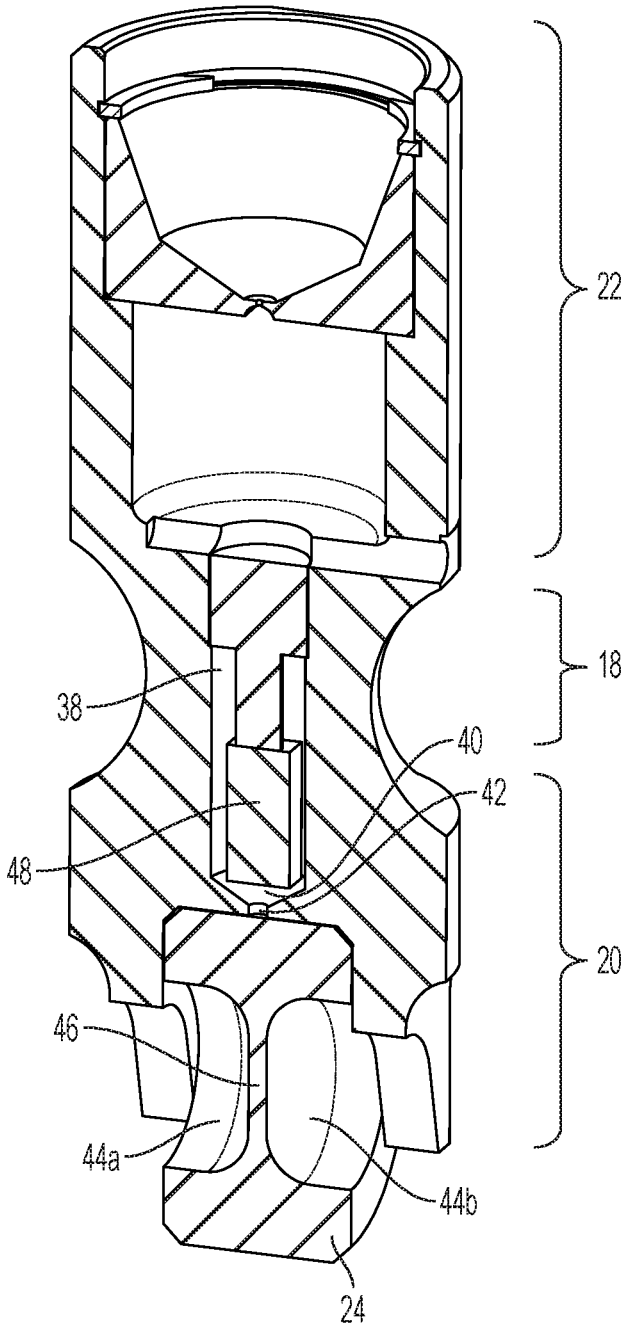
FIG. 3 is a cross-sectional view of the axleless roller valve lifter of FIG. 1 along a plane parallel to a center axis of the roller.
Figure 7:
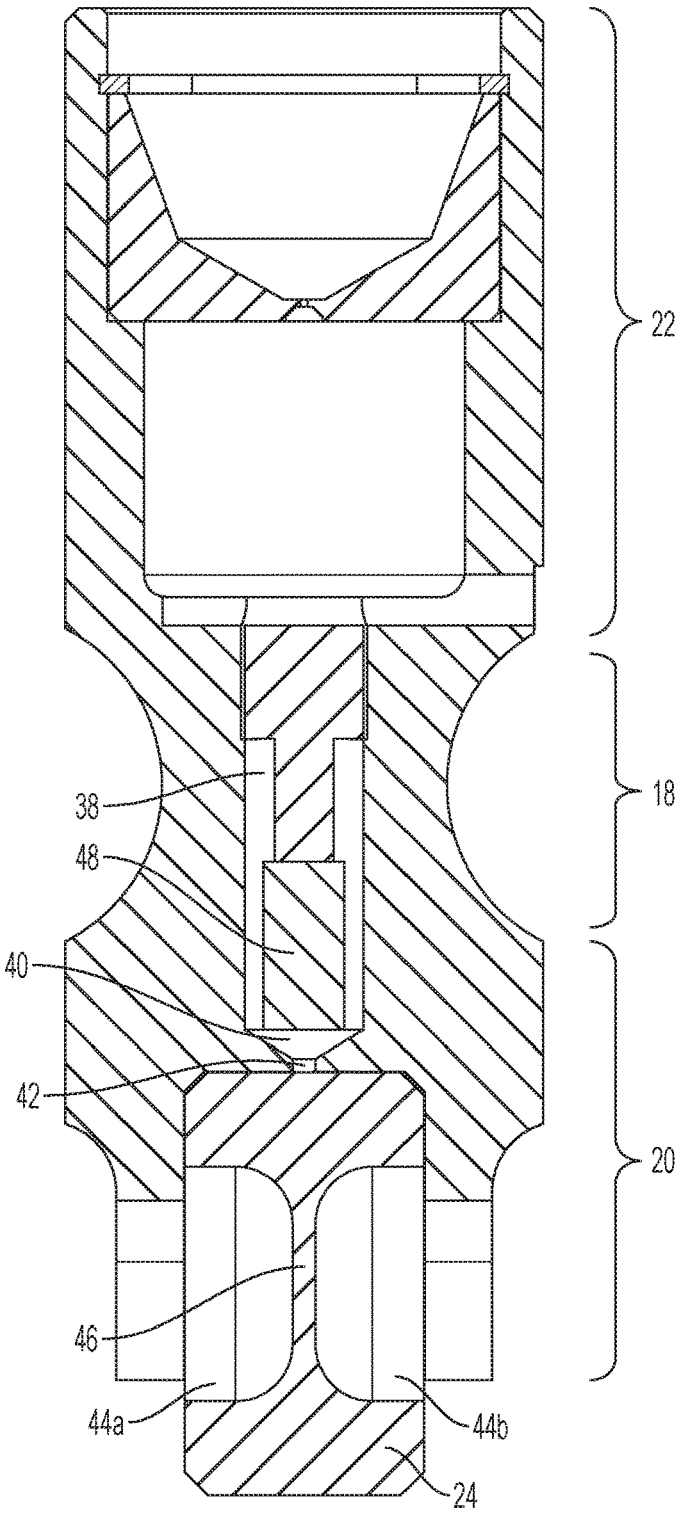
FIG. 7 is a close-up cross-sectional view of the axleless roller valve lifter of FIG. 1.

As seen in the cross-sectional views of FIGS. 3 and 7, roller wheel 24 is generally cylindrical in shape with concave recessed sides 44*a*, 44*b* defining an integral partition hub 46 through the center of the wheel. Preferably the roller wheel 24 is made of steel, with the concave sides allowing a reduced weight and the partition hub 46 providing additional strength as compared to a conventional solid wheel design.

A rectangular permanent magnet 48 is positioned in the cylindrical passageway 38 extending through the axial center of the main body 12, against the conical guide 40 at the lower end of the passageway. The rectangular magnet within the cylindrical passageway 38 leaves gaps between the sides of the magnet 48 and the interior wall of the passageway to allow oil to flow around and past the magnet 48 to the conical guide 40 and oil aperture 42.

The magnetic field of the permanent magnet 48 is operable to exert a holding force on the steel roller wheel 24 to assist in retaining the roller wheel 24 within the wheel socket 26. Because the main body 12 is formed of aluminum, the magnet 48 does not affect or react with the body of the lifter.

A plug-shaped check valve 50, having a larger diameter cylindrical main portion 52 with a concentric smaller diameter secondary portion 54 extending therefrom, is likewise positioned within the cylindrical passageway 38, the check valve 50 operable to allow oil to flow downwardly through the cylindrical passageway 38 and to prevent oil from flowing upwardly through that passageway. Oil thus is permitted to flow from the aperture 13 to the lower section 20. In the event of an upward impact to the roller wheel 24, such as through contact with the cam and/or impact transmitted back through the pushrod to the lifter, the check valve 50 prevents oil between the roller wheel 24 and the inner surface of the wheel socket 26 from being forced back upwardly through the oil aperture 42, thus preventing potential contact between the roller wheel 24 and the wheel socket 26 and corresponding potential damage. The spring-loaded check valve ball set inside the check valve 50 for allowing only a one-way flow of oil is preferably formed from ceramic or other non-metallic material to prevent the magnetic force of the permanent magnet 48 form holding the check ball open or hindering its operation.

A hydraulic plunger 56 positioned in the upper portion of the inner cavity 34 of the upper section 22 of the main body 12 provides a hydraulic cushion and/or preload to the push rod seat 28, which is positioned over and around the hydraulic plunger 56. As previously described, a retaining clip 30 is fitted into a groove 32 formed in the inner wall of the inner cavity 34 to secure the push rod seat 28, hydraulic plunger 56, check valve 50, and permanent magnet 48 within the upper section 22 of the lifter main body 12.

With the structure of the axleless roller valve lifter of the present invention set forth, the operation of the lifter will now be described with reference to the exemplary embodiment depicted in FIGS. 1 through 7.

The axleless valve lifter of the present invention is assembled by placing the permanent magnet 48 and check valve 50 into the cylindrical passageway 38 formed along the center axis of the main body 12, connecting the upper section 22 and the lower section 20. The hydraulic plunger 56 and push rod seat 28 are placed in the inner cavity 34 of the upper section 22, with the retaining clip 30 fixed into the groove 32 in the interior wall of the inner cavity 34 to secure the aforementioned parts therein.

The steel roller wheel 24 is inserted into the wheel socket 26 and is held in position by the magnetic force of the permanent magnet 48.

With the axleless roller valve lifter thus assembled, the lifter may be used in place of a conventional roller valve lifter in an internal combustion engine. In use, oil from the mid-section of the main body 12 flows downwardly through cylindrical passageway 38, past the check valve 50 and magnet 48, and through the conical guide 40 and oil aperture 42 into the wheel socket 26. The oil within the wheel socket 26 forms a thin film between the inner surface of the wheel socket 26 and the outer surface of the roller wheel 24 to allow the roller wheel to glide against the film as the roller wheel rolls in following the eccentric cam it rides upon. The magnet 48 assists in retaining the steel roller wheel 24 within the aluminum main body 12 of the lifter, without the use of a supporting axle or corresponding needle valves which are prone to wear and failure.

In the event of impact to the roller wheel 24, such as through contact with the cam, and/or forces transmitted from the combustion cycle of the cylinder, the check valve 50 prevents oil from being forced upwardly through the oil aperture 42 and back into the cylindrical passageway 38. Thus, the thin oil film between the roller wheel 24 and the wheel socket 26 remains intact upon impact from the rotating cam lobe.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

From the above, it can be seen that the axleless roller valve lifter of the present invention overcomes shortcomings of conventional roller valve lifters as known in the prior art, and provides additional features and benefits that the prior art designs do not.

While the system and method of the present invention have been described herein with respect to an exemplary embodiment, it should be understood that variations and alternate configurations of the disclosed features are contemplated by the present invention. For example, while the exemplary embodiment describes an axleless roller valve lifter having a permanent magnet and a check valve, other combinations of those features are within the scope of the present invention, such as an axleless roller valve lifter without a magnet or check valve, or an axleless roller valve lifter with a check valve, but no magnet. These and other variations are contemplated by the present invention.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. An axleless roller valve lifter, comprising:

a main body comprising upper, mid, and lower sections, wherein the lower section defines a wheel socket having a curvature with a diameter corresponding to an outer diameter of a roller wheel;

the roller wheel nested within the wheel socket such that the roller wheel is contained within the wheel socket by a magnetic field of a permanent magnet.

2. The axleless roller valve lifter of claim 1, wherein the roller wheel is comprised of steel.

3. The axleless roller valve lifter of claim 2, wherein the roller wheel is cylindrical in shape, with concave sides forming a center partition support.

4. The axleless roller valve lifter of claim 1, further comprising a cylindrical passageway allowing oil to flow between the mid section and the lower section.

5. The axleless roller valve lifter of claim 4, wherein the permanent magnet is positioned in the cylindrical passageway such that the permanent magnet exerts the magnetic field on the roller wheel to retain the roller wheel within the wheel socket.

6. The axleless roller valve lifter of claim 4, further comprising a check valve positioned in the cylindrical passageway and operable to prevent oil flow from the lower section to the mid section.

7. The axleless roller valve lifter of claim 1, further comprising a push rod seat positioned within the mid section and a retainer clip operable to secure the push rod seat therein, wherein the retainer clip permits an offset in the push rod seat.

8. The axleless roller valve lifter of claim 1, further comprising a removable hydraulic cartridge positioned within the mid section.

9. The axleless roller valve lifter of claim 1, wherein the main body comprises hard anodized aluminum.

* * * * *